US009226581B2

(12) United States Patent
Rivera

(10) Patent No.: US 9,226,581 B2
(45) Date of Patent: Jan. 5, 2016

(54) RECLINABLE SEATING APPARATUS AND METHOD

(71) Applicant: TROPITONE FURNITURE CO., INC., Irvine, CA (US)

(72) Inventor: Richard Rivera, Corona, CA (US)

(73) Assignee: Tropitone Furniture Co., Inc., Irvine, CA (US)

( * ) Notice: Subject to any disclaimer, the term of this patent is extended or adjusted under 35 U.S.C. 154(b) by 0 days.

(21) Appl. No.: 14/741,177

(22) Filed: Jun. 16, 2015

(65) Prior Publication Data

US 2015/0272330 A1 Oct. 1, 2015

Related U.S. Application Data

(63) Continuation of application No. 14/247,109, filed on Apr. 7, 2014, now Pat. No. 9,084,488, which is a continuation of application No. 13/942,347, filed on Jul. 15, 2013, now Pat. No. 8,690,247, which is a continuation of application No. 12/881,012, filed on Sep. 13, 2010, now Pat. No. 8,534,758.

(51) Int. Cl.
*A47C 1/032* (2006.01)

(52) U.S. Cl.
CPC ..... *A47C 1/03294* (2013.01)

(58) Field of Classification Search
CPC .. A47C 1/032; A47C 1/03205; A47C 1/0325; A47C 1/03294
USPC ..... 297/342, 341
See application file for complete search history.

(56) References Cited

U.S. PATENT DOCUMENTS

| | | | |
|---|---|---|---|
| 2,151,729 | A | 3/1939 | Baker |
| 2,313,023 | A | 3/1943 | Ruegger |
| 2,529,451 | A | 11/1950 | Hoven et al. |
| 2,627,898 | A | 2/1953 | McStay Jackson |
| 2,807,310 | A | 9/1957 | Sellner |
| 3,305,264 | A | 2/1967 | Gunn |
| 3,773,383 | A | 11/1973 | Ekornes |
| 3,806,193 | A | 4/1974 | Faiks |
| 3,870,365 | A | 3/1975 | Knutsen |
| 3,934,932 | A | 1/1976 | Ekornes |

(Continued)

OTHER PUBLICATIONS

U.S. Appl. No. 12/881,012, filed Sep. 13, 2010, Rivera.

(Continued)

*Primary Examiner* — Milton Nelson, Jr.
(74) *Attorney, Agent, or Firm* — Knobbe Martens Olson & Bear LLP

(57) ABSTRACT

In various embodiments, self-adjusting reclinable seating is disclosed. When the user applies a force to the seating by shifting his or her center of gravity, the backrest and seat portions of the seating move in response to the force to recline the seating. The user can return the seating to an upright position by again shifting his or her center of gravity. Such a configuration eliminates the need for manual recline controls. The seating is further configured to continuously vary the angle of the seat and backrest portions relative to the ground as the user moves. In particular, vertical distance between the front of the seat and the ground increases as the backrest reclines. Continuously varying the angle of both the seat and the backrest portions of the seating relative to the ground may improve a user's seating comfort, for example, by decreasing or eliminating the user's need to shift position on the seat when reclined.

16 Claims, 10 Drawing Sheets

(56) References Cited

U.S. PATENT DOCUMENTS

| | | | |
|---|---|---|---|
| 3,947,069 | A | 3/1976 | Lusch |
| 4,126,355 | A | 11/1978 | Rosenheck |
| 4,359,245 | A | 11/1982 | Franke |
| 4,364,606 | A | 12/1982 | Eknes |
| 4,387,876 | A | 6/1983 | Nathan |
| 4,580,834 | A | 4/1986 | de la Sota Martinez |
| 4,660,884 | A | 4/1987 | Terui et al. |
| 4,753,482 | A | 6/1988 | Warren |
| 4,768,829 | A | 9/1988 | Goldman |
| 4,925,228 | A | 5/1990 | Pipon et al. |
| 4,941,709 | A | 7/1990 | Möller |
| 5,082,324 | A | 1/1992 | Harada et al. |
| 5,137,330 | A | 8/1992 | Lie et al. |
| 5,215,352 | A | 6/1993 | Yeh et al. |
| 5,356,172 | A | 10/1994 | Levy et al. |
| 5,944,385 | A | 8/1999 | Pearce |
| 5,967,609 | A | 10/1999 | Potter |
| 6,012,774 | A | 1/2000 | Potter |
| 6,050,642 | A | 4/2000 | Erb |
| 6,126,186 | A | 10/2000 | Mascari |
| 6,161,898 | A | 12/2000 | Brevi |
| 6,206,393 | B1 | 3/2001 | Mascari et al. |
| 6,238,001 | B1 | 5/2001 | Yoran |
| 6,315,358 | B1 | 11/2001 | Baru |
| 6,375,261 | B1 | 4/2002 | Link |
| 6,511,128 | B2 | 1/2003 | Piretti |
| 6,698,833 | B2 | 3/2004 | Ball et al. |
| 6,736,457 | B2 | 5/2004 | Elio et al. |
| 6,805,406 | B1 | 10/2004 | Jansen |
| 6,827,650 | B1 | 12/2004 | Tseng |
| 6,913,315 | B2 | 7/2005 | Ball et al. |
| 6,951,371 | B2 | 10/2005 | Wang |
| 7,000,988 | B2 | 2/2006 | Bressler et al. |
| 7,125,077 | B2 | 10/2006 | Frank |
| 7,188,900 | B1 | 3/2007 | Raftery |
| 7,273,255 | B2 | 9/2007 | Nylander et al. |
| 7,407,229 | B1 | 8/2008 | Chen |
| 7,735,924 | B2 | 6/2010 | Lin |
| 7,735,925 | B2 | 6/2010 | Lin |
| 8,534,758 | B2 | 9/2013 | Rivera |
| 8,690,247 | B2 | 4/2014 | Rivera |
| 2004/0256899 | A1 | 12/2004 | Moore et al. |
| 2005/0140183 | A1 | 6/2005 | Conte |
| 2006/0238006 | A1 | 10/2006 | Baranov et al. |
| 2008/0061615 | A1 | 3/2008 | McBride et al. |
| 2008/0231099 | A1 | 9/2008 | Szczepkowski et al. |
| 2012/0062008 | A1 | 3/2012 | Rivera |
| 2013/0300172 | A1 | 11/2013 | Rivera |
| 2014/0217795 | A1 | 8/2014 | Rivera |

OTHER PUBLICATIONS

U.S. Appl. No. 13/942,347, filed Jul. 15, 2013, Rivera.
U.S. Appl. No. 14/247,109, filed Apr. 7, 2014, Rivera.

RECLINABLE SEATING APPARATUS AND METHOD

CROSS-REFERENCE TO RELATED APPLICATIONS

This application is a continuation of U.S. patent application Ser. No. 14/247,109, filed Apr. 7, 2014, now U.S. Pat. No. 9,084,488, issued Jul. 21, 2015, which is a continuation of U.S. patent application Ser. No. 13/942,347, filed Jul. 15, 2013, now U.S. Pat. No. 8,690,247, issued Apr. 8, 2014, which is a continuation of U.S. patent application Ser. No. 12/881,012, filed Sep. 13, 2010, now U.S. Pat. No. 8,534,758, issued Sep. 17, 2013, the entire contents of each of which are incorporated herein by reference.

BACKGROUND

1. Field

The present disclosure relates to reclinable seating, and more particularly to self-adjusting reclinable seating.

2. Description of the Related Art

Reclinable seating has been known for many years. Early solutions to devising seating with a reclining backrest used manual recline controls with prefixed reclining positions, for example, employing notches in the hinged connection between the backrest and the seat or by using notches in the armrests of the seating. These early solutions, although still widely used, are deficient because of their very limited range of recline positions and because many do not permit the seat to move in relation to the backrest.

The related art has attempted to solve the deficiencies of manual recline controls with self-adjusting reclinable seating. Self-adjusting reclinable seating does not rely upon prefixed reclining positions. This allows the seating to be positioned anywhere along a range of movement. However, a user may find the positioning of the seat and backrest in the reclining positions in the seating solutions offered by the prior art to be uncomfortable and, consequently, shift his or her position on the seat to accommodate for the backrest's angle of recline. Accordingly, a need remains for seating that improves user comfort and decreases or eliminates the user's need to shift position on the seat when reclined.

SUMMARY

In various embodiments, reclinable seating is disclosed that continuously moves the seat and backrest portions relative to the ground as the user moves. When the user applies a force to the seating by shifting his or her center of gravity, the backrest and seat portions of the seating move in response to the force to recline the seating. The seating is preferably configured to compensate for the tendency of the seat portion to tilt downwards as the backrest portion reclines. Preferably, the front portion of the seat inclines upwards as the backrest reclines. In some embodiments, the position of the seat relative to the ground forms an acute angle, and the angle of the seat relative to the ground is substantially maintained as the seat moves forward and the backrest reclines. Alternatively, the angle of the seat relative to the ground can decrease as the backrest reclines. In certain preferred embodiments, however, the vertical distance of the front of the seat relative to the ground increases. The user can return the seating to an upright position by again shifting his or her center of gravity. Such a configuration eliminates the need for manual recline controls. This seating may improve a user's seating comfort, for example, by decreasing or eliminating the user's need to shift position on the seat when reclined.

The seating can comprise a frame structure to which the backrest portion is pivotably coupled, but the seat portion is not itself pivotally coupled to the frame structure.

The seating can comprise a seat portion that rides on a fixed track that does not move with the seat.

In seating that comprises side or lateral frame structures generally on either side of the seat portion those structures can be formed from at least front and rear upright members, typically joined at their upper portions by a member at least some of which forms an arm rest. Such seating can also comprise at least one cross member joining either or both of the front and rear upright members. Preferably, the track upon which the seat portion rides is not on or part of the upright members or armrest, but is an additional member.

The track can extend generally from the front to the rear portions of the seating between either the front and rear upright members and/or the front and rear cross members. The track can extend generally alongside the seat portion and/or underneath it or in a plane lower than that of the seat portion. Typically, there will be two tracks associated with each seating portion.

The rear portion of the seat in some embodiments is not lifted during the reclining of the seating. Some preferred embodiments of the invention seek to enhance comfort of and convenience of use for the user by configuring the seating such that, in use, the front of the seat portion will rise. The plane or angle of the seat portion, with respect to its front, may decrease with respect to the floor or ground as the seating is reclined, or the plane or angle may remain relatively constant.

In at least one embodiment, seating comprises a backrest configured to recline from an upright position and a seat hingeably connected to the backrest at the rear portion of the seat. The seat is configured to move in relation to the backrest. The seating also includes a track that extends substantially parallel to the sides of the seat. A guide assembly is fixedly attached to the seat and slideably engaged with the track, such that the guide assembly supports the seat on the track. The guide assembly can extend laterally from a side of the seat or extend downwardly from the bottom of the seat. The guide assembly is configured to slide along the track upon application of a force to the backrest and/or seat. Such seating can be incorporated into furniture, such as a chair, couch, or chaise lounge.

Preferably, the guide assembly and track are configured to lift the front portion of the seat as the backrest reclines. For instance, the track can be configured such that at least a portion of the track slopes downward from the direction of the front portion of the seat to the direction of the rear portion of the seat. The guide assembly can be engaged with the track such that the guide assembly is higher on the slope of the track when the backrest is reclined than when the backrest is upright. The guide assembly can include a frictional control, such as a friction member or a knob, for adjusting the amount of friction between the guide assembly and the lower portion of the track. Such frictional control can be used as a tightening mechanism to prevent the guide assembly from sliding on the track, thereby maintaining the seat and backrest in a fixed position.

In certain embodiments, the seating includes a frame. The frame can comprise a front member disposed near the front portion of the seat and/or a rear member disposed near the rear of the seat. The track can extend between the front member and the rear member of the frame. In some embodiments, the track adjoins the front member and the rear member of the frame. Alternatively, the track can be connected to either the front member or the back member. The track need not be connected to either the front or back member.

When present, the front member can be upwardly extending or it can be laterally extending. Like the front member, the rear member can be upwardly or laterally extending. In some embodiments, a second rear member extends perpendicularly from the rear member and provides support for the backrest. The second rear member can be pivotally connected to the backrest. In some embodiments, the second rear member can comprise a pivot, and the backrest is attached to the pivot. The second rear member could also comprise a generally horizontally-extending bar, and the backrest contacts the bar.

The track can optionally comprise at least one stop configured to limit the range of motion of the guide relative to the track. In certain embodiments, the track includes an upper portion and a lower portion separated by one or more generally upward-extending member, such as a bend in the track. The guide assembly can be engaged with the lower portion of the track, which slopes downward from the direction of the front portion of the seat to the direction of the first portion of the seat. The extent of slide of the guide assembly can be limited by the upward-extending member(s) on the track.

In some embodiments the seating comprises a backrest configured to recline from an upright position; a seat comprising a front portion and a rear portion and hingeably connected to the backrest at the rear portion of the seat, the seat being configured to move in relation to the backrest; a frame comprising: an upwardly-extending front member disposed near the front portion of the seat, an upwardly-extending rear member disposed near the rear portion of the seat, a pivot member extending generally horizontally from the rear member and connected to the backrest so that the backrest can pivot about the pivot member, and a track extending between the front member and the rear member. The track has an upper portion, a lower portion, and two generally upward-extending bends connecting the upper portion to the lower portion, at least the lower portion of the track sloping downward from the direction of the front member to the direction of the rear member; and a guide configured to support the seat on the track. The guide is fixedly attached to the seat and slideably engaged with the downward-sloping lower portion of the track, such that the guide is configured to slide along the track upon application of a force to the backrest and/or seat, and the guide being configured to be higher on the slope of the track when the backrest is reclined than when the backrest is upright, the extent of slide being limited by the two generally upward-extending bends on the track.

In some embodiments there is provided reclinable seating comprising: a backrest configured to recline from an upright position; a seat comprising a front portion and a rear portion and hingeably connected to the backrest at the rear portion of the seat, the seat being configured to move in relation to the backrest and a frame. The frame comprises a front member being disposed near the front portion of the seat, a rear member being generally upright and disposed near the rear portion of the seat, a pivot member extending generally horizontally from the rear member and contacting the backrest so that the backrest can pivot about the pivot member. The seating further comprises track extending from the front member toward the rear member, at least a portion of the track sloping downward from the direction of the front member to the direction of the rear member; and a guide configured to support the seat on the track, the guide being fixedly attached to the seat and slideably engaged with the downward-sloping portion of the track, such that the guide is configured to slide along the track upon application of a force to the backrest and/or seat, and the guide being configured to be higher on the slope of the track when the backrest is reclined than when the backrest is upright.

In some embodiments, there is provided reclinable seating comprising: a backrest configured to recline from an upright position; and a seat comprising a front portion and a rear portion and hingeably connected to the backrest at the rear portion of the seat; and a guide fixedly engaged with the seat and slidingly engaged with a track disposed proximate the seat, the guide and track being configured to incline the front portion of the seat as the backrest reclines.

BRIEF DESCRIPTION OF THE DRAWINGS

A general structure that implements the various features of the disclosed apparatuses and methods will now be described with reference to the drawings. The drawings and the associated descriptions are provided to illustrate embodiments and not to limit the scope of the disclosure.

Throughout the drawings, reference numbers are reused to indicate correspondence between referenced elements. In addition, the first digit of each reference number indicates the figure it which the element first appears.

DETAILED DESCRIPTION

Figure 1A:
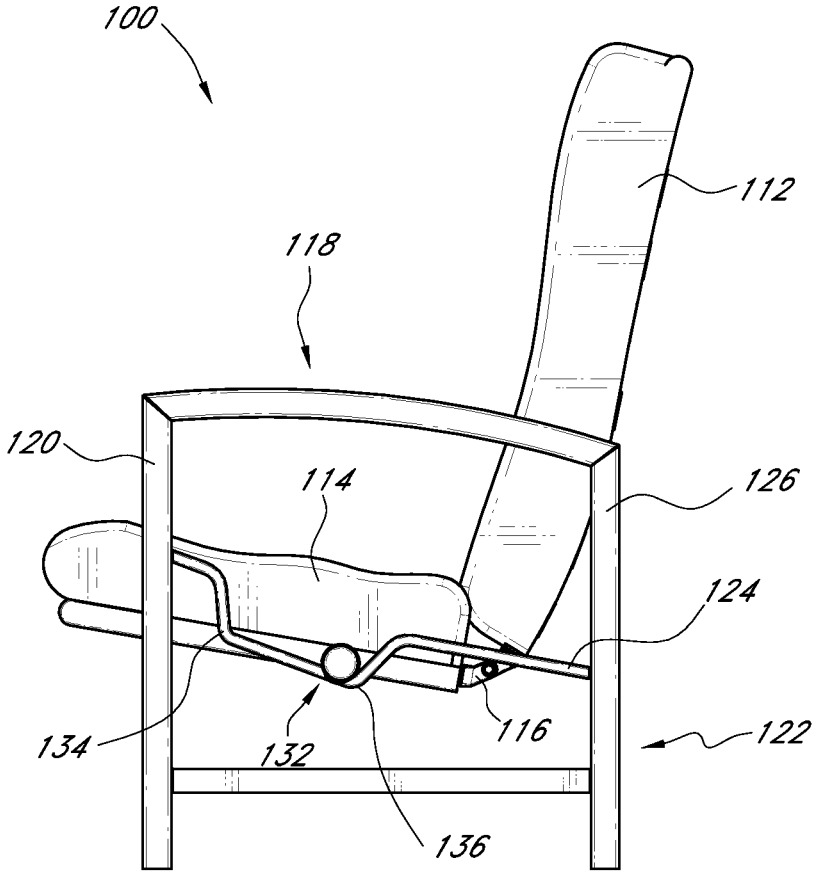
FIG. 1A is a side view of reclinable seating in an upright position.
Figure 1B:
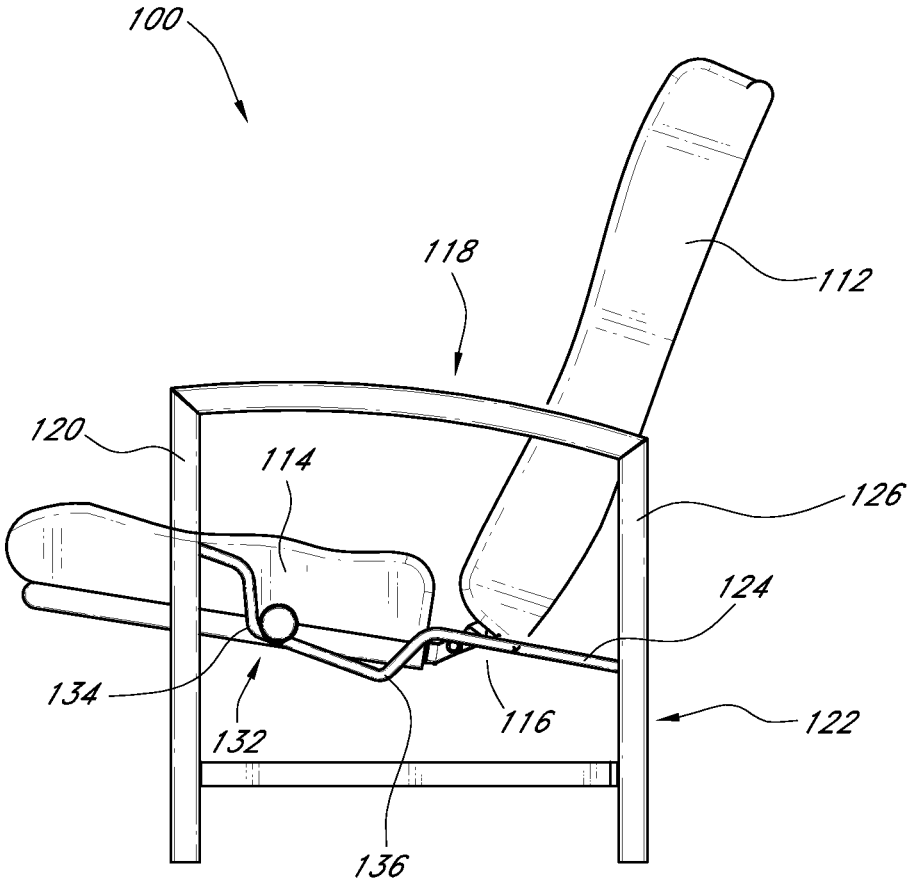
FIG. 1B is a side view of the reclinable seating in a fully reclined position.

An example embodiment of reclinable seating 100 is shown in FIG. 1A and FIG. 1B. In this example, the seating 100 is a chair. However, the seating 100 can be integrated into a variety of formal and casual, indoor and outdoor seating options, such stationary or swivel rockers or chairs, lounge chairs, action loungers or swivel action loungers, chaise loungers, settees, love seats, couches, and the like.

The seating 100 comprises a backrest 112 portion that is configured to recline from an "upright" position, as shown in FIG. 1A, to a "fully reclined" position, as shown in FIG. 1B. For more formal dining-type seating, the backrest 112 can be in the range of about 102° to 122° (e.g., around 110°) relative to the ground in the upright position and in the range of about 123° to 143° (e.g., around 133°) relative to the ground in the fully reclined position. For lounge-type seating, the backrest 112 can in the range of about 104° to 124° (e.g., around 113°) relative to the ground in the upright position and in the range of 135° to 155° (e.g., around 145°) relative to the ground in the fully reclined position. The seat 114 is generally in the range of 9° to 16° relative to the ground in the upright position for dining-and deep-type seating. The seat angle for the fully reclined position will be discussed in more detail below.

Figure 2:
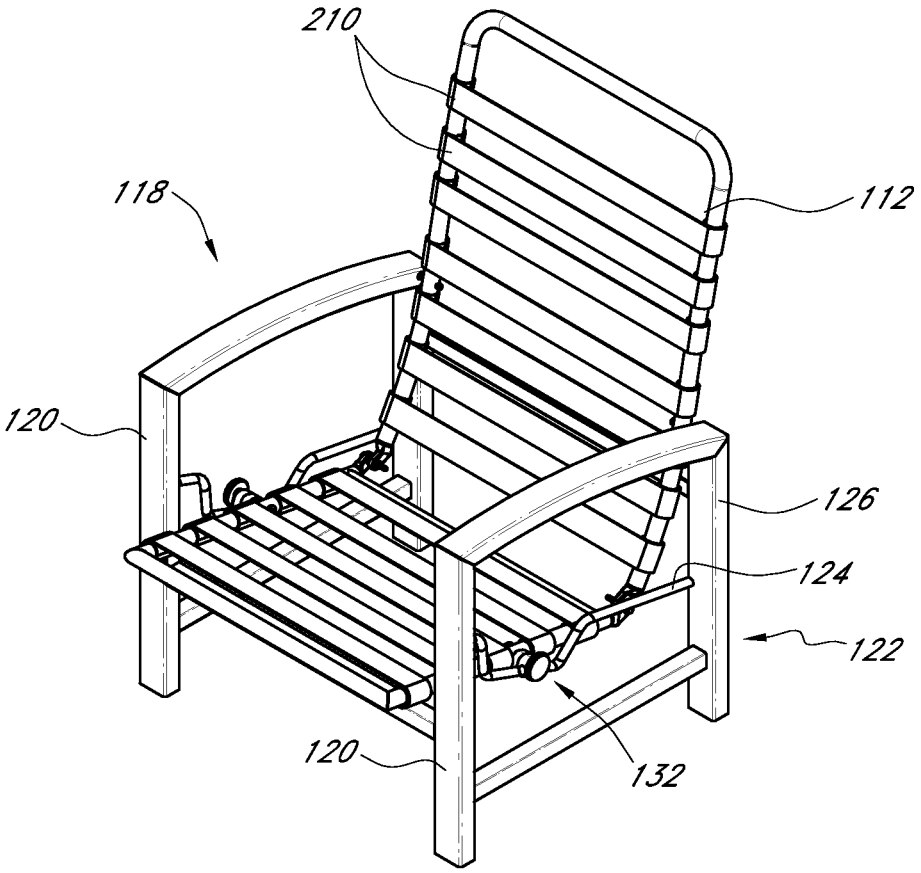
FIG. 2 is a front-perspective view of the reclinable seating comprising supportive straps on the seat and backrest.

The seating 100 is continuously adjustable, in that a user can position the backrest 112 at any point between upright and fully reclined. The seating 100 also comprises a seat 114 portion. Cushioning can be provided on the seat 114 and/or backrest 112. However, such cushioning is optional. As shown in FIG. 2, for instance, the seat 114 and backrest 112 can comprise transverse straps 210 engaged around supportive tubing. As additional examples, the seat and backrest can comprise a fabric or mesh sling, woven straps, or a solid cast material. Sling, strap, and cast seating are known in the art, and the seating disclosed herein can be integrated with each.

With reference to FIG. 1A, the seat 114 can be connected to the backrest 112 at the rear of the seat 114, for example, using a hinge, pin, rod, or other suitable pivot 116, so that the seat 114 can move relative to the backrest 112.

Figure 3A:
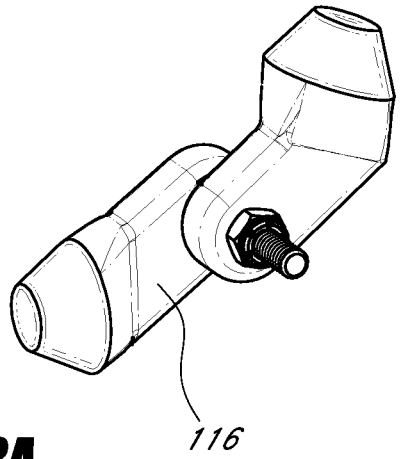
FIG. 3A and 3B are front-perspective views of the inner and outer surfaces of the pivot connection between the backrest and seat in the reclinable seating.
Figure 3B:
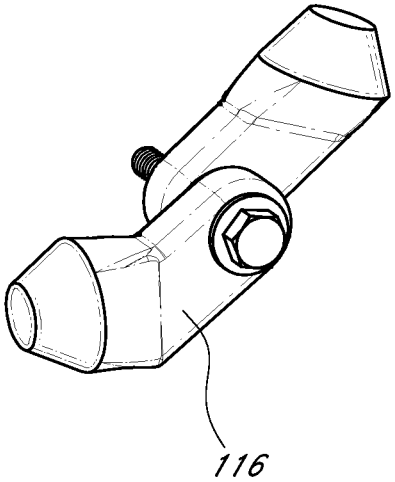

An example pivot 116 is shown in greater detail in FIG. 3A, which shows the pivot 116 from the inside-out, and FIG. 3B, which shows the pivot 116 from the outside-in.

With reference to FIG. 1A, a frame 118 is disposed around the backrest 112 and seat 114. The example frame 118 includes a front member 120, rear members 122, and a track 124.

Figure 4:
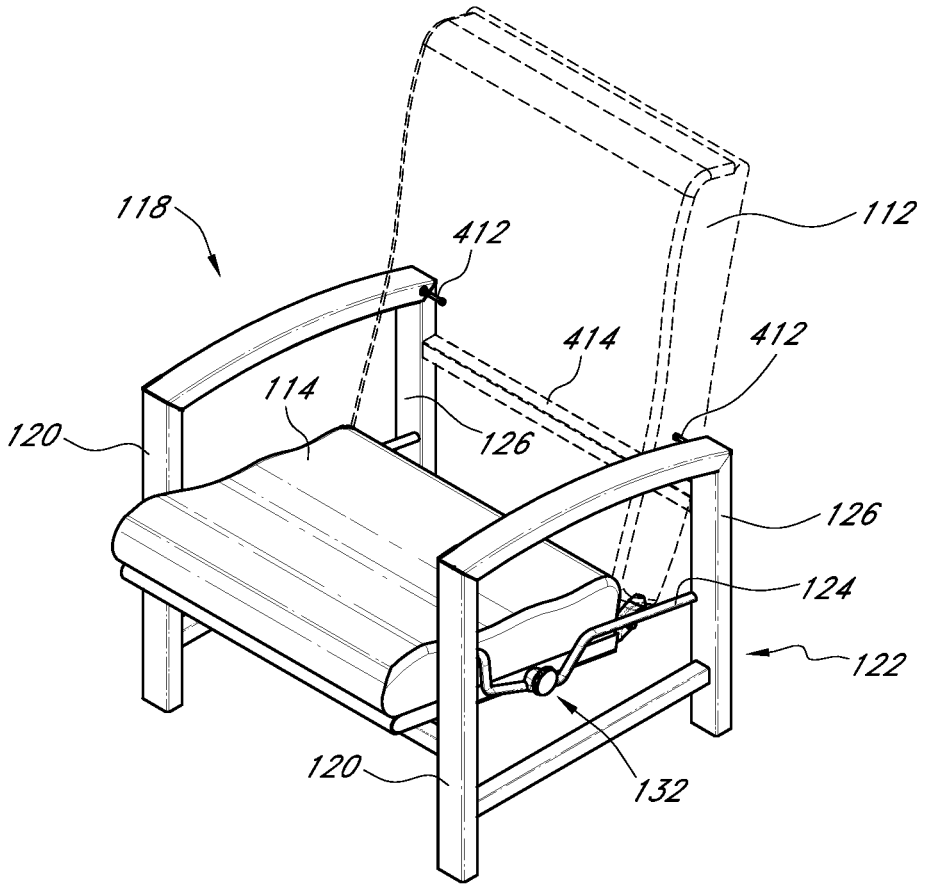
FIG. 4 is a front-perspective view of the reclinable seating in an upright position.
Figure 8:
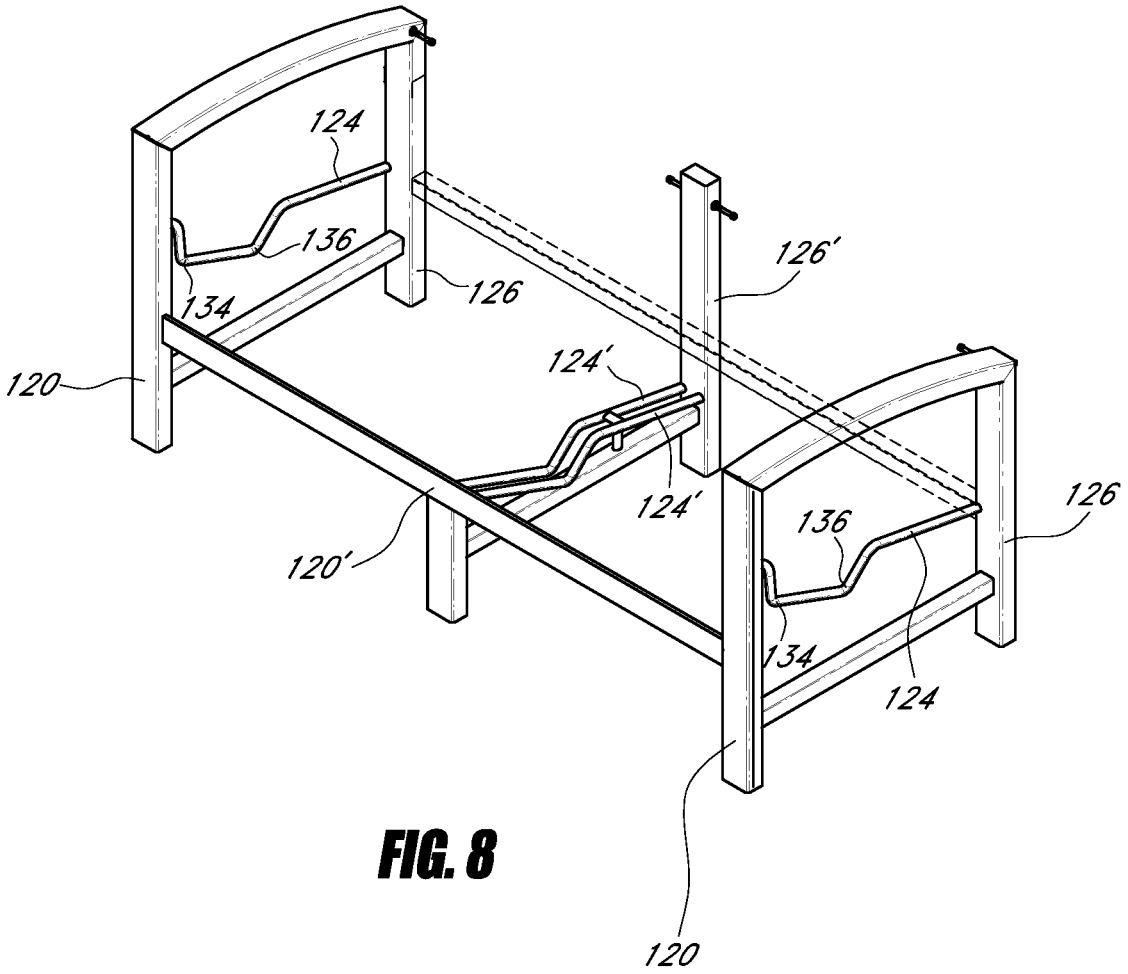
FIG. 8 shows a front-perspective view of an example frame for a love seat comprising the reclinable seating.

The front member 120 is located near the front of the seat 114. Conventional framing components known in the art can be used for the front member 120. For instance, a front arm post or other suitable generally upright framing component can be used, as shown in FIG. 1A. As shown in FIG. 4, two front members 120 can extend upward at a 90° angle relative to the ground. However, any generally upright angle is suitable for use herein. For instance, two front members can be generally trapezoidal relative to each other. Alternatively, a generally horizontal front rail or other non-upright framing component can be used. A front rail 120' is shown in FIG. 8, which is discussed in more detail below. Materials commonly used for framing are woods, such as teak, cedar, oak, or the like, metals, such as aluminum, steel, iron, or the like, or synthetic polymers, such as heavy-duty plastics and composites. These materials are suitable for use in the embodiments disclosed herein.

Referring again to FIG. 1A, the rear members 122 are located near the rear of the seat 114. In this example, the rear members 122 include a first rear member 126 and a second rear member 412, which is omitted from FIG. 1A, but shown in the perspective view of FIG. 4. Again, conventional framing components can be used for the rear members 122, and the first rear member can be positioned at any suitable angle. For example, the first rear member 126 can comprise a generally upright member, such as a back upright slat, or a back arm post, as shown in FIG. 1A. A back rail, crest rail, or other generally horizontal framing component, such as the back rail 414 in FIG. 4, is also suitable. Other irregular angles, such as trapezoidal angles, are also suitable for use.

In the example embodiment of FIG. 4, a second rear member 412 extends substantially horizontally, e.g., generally perpendicularly, from the first rear member 126. The second rear member 412 is configured to provide support for the backrest 112, and to provide a pivot connection to the frame 118 that allows the backrest 112 to move in relation to the seat 114. The second rear member 412 can comprise a hinge, pin, rod, ball and socket, or other suitable pivot connection adjoined to or passing through the backrest 112.

As explained above, the second rear member 412 provides a pivotal connection to the backrest 112. However, the second rear member 412 could be removed, and the back rail 414 or crest rail extending perpendicularly from the first rear member 126 could serve a similar function. In such an embodiment, the backrest 112 does not pivot about a connection to the frame 118. Rather, the backrest 112 would abut the frame 118 at the back rail 414, and pivot about the abutment.

Returning again to FIG. 1A, a track 124 extends from the front member 120 toward (that is, in the direction of) the rear members 122. Preferably, the track 124 adjoins both the front member 120 and the first rear member 126, but it need not do so. For instance, the track could contact the front member 120 and the ground.

Figure 5:
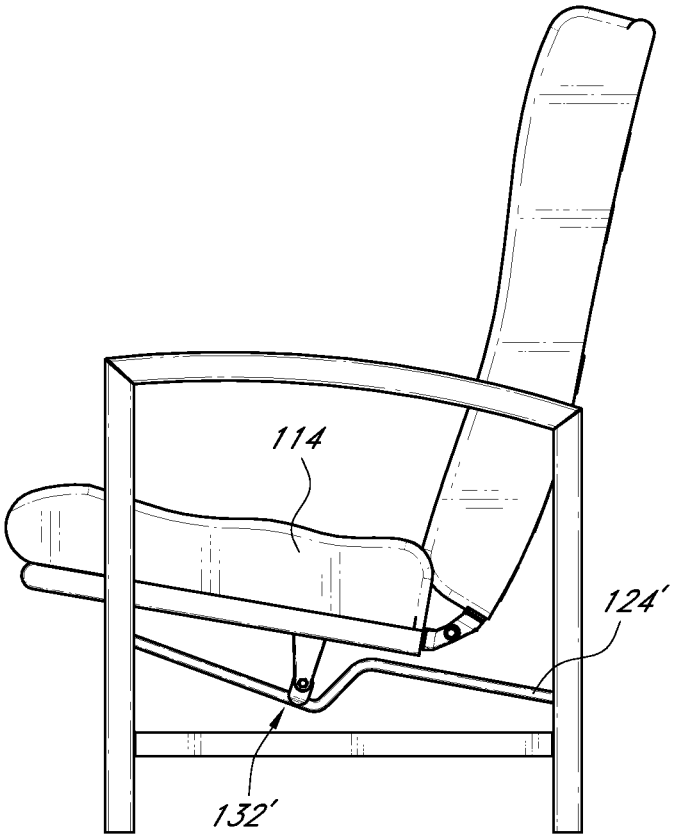
FIG. 5 is a side view of the reclinable seating showing an alternative position for the guide assembly.

A guide assembly 132 is configured to support the seat 114 on the track 124. In FIG. 1A, the guide assembly 132 extends laterally from the side of the seat 114 and engages a portion of the track to the side of the seat 114. An alternative configuration for the guide assembly 132' is shown in FIG. 5. In that example, the guide assembly 132' extends downwardly from the seat 114 and engages a portion of track 124' underneath the seat 114. Such a track-and-guide assembly configuration can be advantageously incorporated into seating lacking one or more armrests, as explained in detail below.

Figure 6:
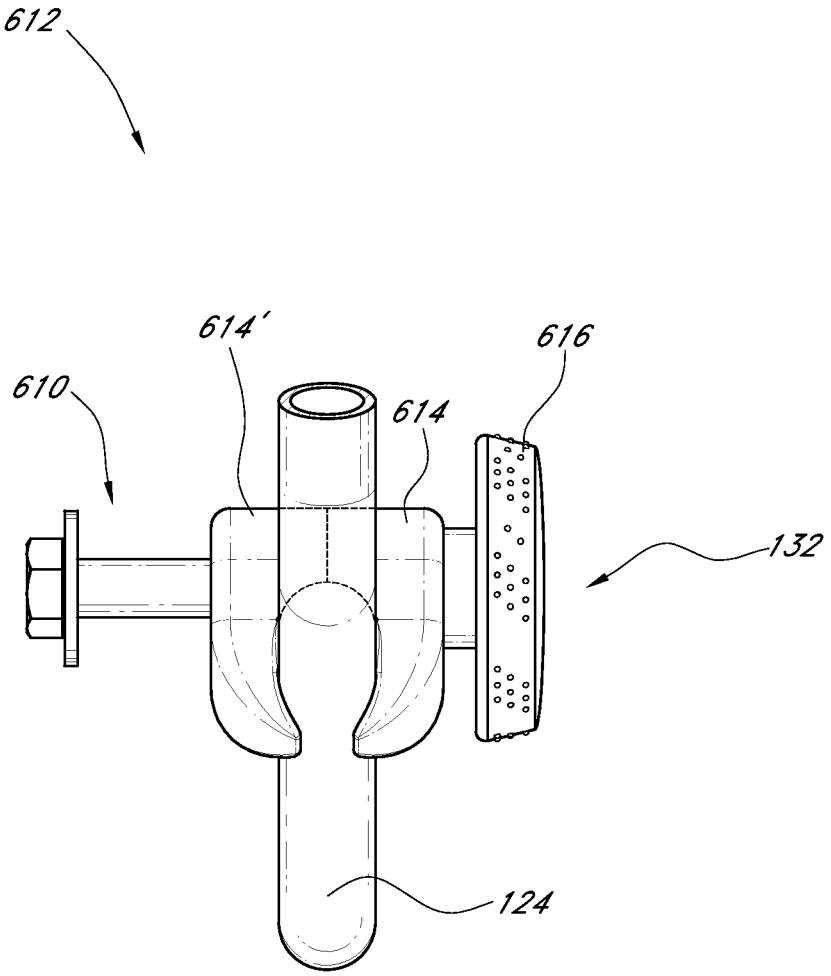
FIG. 6 is a bottom-perspective view of a track and guide assembly used in the reclinable seating.
Figure 7:
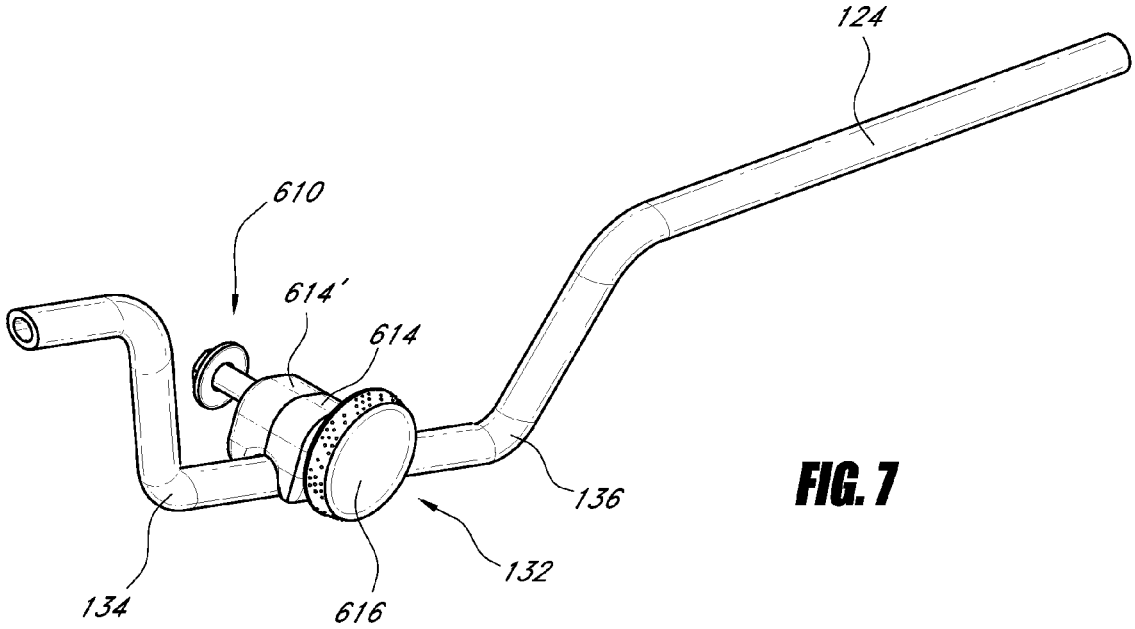
FIG. 7 is a side-perspective view of a track and guide assembly used in the reclinable seating.

An example guide assembly 132 is shown in greater detail in FIG. 6 and FIG. 7. In this example, the guide assembly 132 comprises a connector portion 610 that is fixedly attached to the seat (not shown). Suitable methods for attaching the connector portion 410 and the seat are known in the art and include screwing, bolting, and so on. The guide assembly 132 also includes a slide portion 612, comprising a device such as a slide shoe or cylinder, which is slideably engaged with the track 124. In this example, the slide portion 612 includes a first half slide shoe 614 and a second half slide shoe 614' engaged around the track 124. At least the inner surfaces of the first half slide shoe 614 and the second half slide shoe 614' are made of a durable material having a low coefficient of friction with the track 124. The coefficient of friction should be sufficiently low to permit the slide portion 612 to easily slide on the track 124 when the user changes his or her center of gravity on the seating 100. Furthermore, the material should be sufficiently durable to withstand repeated use under heavy loads. DELRIN®, a polyoxymethylene plastic originally manufactured by DuPont, which is hard, yet has a dynamic coefficient of friction against steel in the range of about 0.19 to 0.41, has been used successfully. However, a variety of durable, low-friction materials, such as compositions of rubbers, resins and plastics (e.g., PTFE, HDPE, TEFLON®), ceramics (e.g., BN), metals (bronze, Mb), and/or graphite are also contemplated for use in the slide portion 612.

In certain embodiments, the guide assembly 132 also includes a frictional control 616, such as a knob, that permits a user to increase the amount of friction between the slide portion 412 and the track 124. In this example, the frictional control 616 is in the form of a wheel. However, alternative knobs, such as a bar, cubical or spherical member, and the like are also suitable for use. In the embodiment of FIG. 6 and FIG. 7 the frictional control 616 increases the tightness of the first half slide shoe 614 and a second half slide shoe 614' around the track 124. Preferably, the frictional control 616 is adjusted so that the amount of friction between the slide portion 612 and the track 124 is large enough such that a user, sitting relatively still in an equilibrium position, will not cause the slide portion 612 to slide along the track 124. However, the adjustment will preferably keep the coefficient sufficiently low, such that when the user shifts his or her center of gravity, the slide portion 612 will slide along the track 124 in response to the shift.

As the slide portion 612 slides along the track 124 in response to changes in the user's center of gravity, the seat (not shown) and backrest (not shown) will move accordingly to accommodate the user's position. Thus, once the user adjusts the frictional control 616 to the user's specific body weight, the seating (not shown) will adjust itself to various positions simply by the user shifting his or her weight.

After the initial adjustment, the frictional control 616 no longer needs to be adjusted. However, the frictional control 616 can be adjusted at any time to "lock" the seating 100 into a particular position by increasing the coefficient of friction between the track 124 and the slide portion 612, such that the slide portion 612 will not move if the user changes his or her center of gravity.

Although the frictional control 616 advantageously permits a high degree of customization to a user's particular weight and center of gravity, it is optional. For example, the materials and configuration of the slide portion 612 can be selected to provide a coefficient of friction that is sufficiently high to permit the slide portion 612 to hold its position when the user stops changing his or her center of gravity for a majority of users, for example, assuming a normal distribution around an average user weight of about 180 lbs (81.6 kg). This configuration would advantageously allow the seating (not shown) to hold an equilibrium position until application of force, as described above, for most users. Materials such as DELRIN® have been found to function without such a frictional control 616. Such a configuration could be advantageously employed in, for example, the middle section(s) of a couch in which a frictional control is not easily reachable by the occupant; however, it can be employed in any furniture configuration embodying the disclosed seating.

With reference again to FIG. 1A and FIG. 1B, as the seating 100 moves from the upright position (FIG. 1A) to the fully reclined position (FIG. 1B), the rear portion of the seat 114 begins to lift upward, because the rear portion of the seat 114 is pivotally connected to the backrest 112, which itself is rotatably connected to the frame 118. It was discovered, however, that a user's comfort can be improved if the angle of the seat 114 relative to the ground is maintained in the range of 8° to 22° when the backrest 112 is fully reclined. Maintaining such an angle decreases a user's desire to elevate his or her knees when seated in a reclined position if the angle is too steep or, conversely, obviates the user's feeling of sliding off the seat if the angle is too shallow. Thus, certain embodiments include the realization that reclinable seating 100 should increase vertical distance between the front of the seat 114 and the ground as the backrest 112 reclines, to improve user comfort. Accordingly, some preferred embodiments of the invention seek to enhance comfort of and convenience of use for the user by configuring the seating such that, in use, the front of the seat portion will rise. The plane or angle of the seat portion, with respect to its front, may decrease with respect to the floor or ground as the seating is reclined, or the plane or angle may remain relatively constant.

An example method for increasing the vertical distance between the front portion of the seat 114 and the ground as the backrest 112 reclines is explained below. As shown in FIG. 1A, at least a portion of the track 124 slopes downward, with the higher portion of the slope toward the front member 120 and the lower portion of the slope toward the rear members 122. The guide assembly 132 is engaged with the track 124 within this downward-sloping portion of the track 124. When the backrest 112 is in the upright position, as in FIG. 1A, the guide assembly 132 is engaged with the track 124 near the bottommost portion of the slope. As the backrest 112 reclines, the guide assembly 132 slides up the slope. When the backrest 112 is fully reclined, as in FIG. 1B, the guide assembly 132 is engaged with the track 124 near the topmost portion of the slope. Such a configuration increases the vertical distance between the front of the seat 114 and the ground as the backrest 112 reclines, permitting the seat 114 to have an angle of 9° to 16° relative to the ground when the backrest 112 is upright, and an angle relative to the ground in the range of 8° to 22° when the backrest 112 is fully reclined. This configuration advantageously improves a user's comfort throughout the range of movement of the seating 100.

For a user's safety and/or comfort, it can be desirable to limit the seating 100 movement. As explained above, the rear portion of the seat 114 lifts as the backrest 112 reclines. This motion causes the front portion of the seat 114 to move laterally outward (that is, in a direction away from the backrest). It can be desirable to limit this forward lateral travel to between about 3 in. (7.62 cm) and 8 in. (20.32 cm), for example, to about 4¾ in. (12.07 cm) of forward lateral travel for dining-type seating or about 6.375 in. (16.19 cm) of forward lateral travel for deep-type seating. As another example, it can also be desirable to limit the backward lateral travel of the seat 114 (that is, travel toward the direction of the backrest 112). As the seat 114 moves backward, toward the backrest 112, the backrest 112 will move forward toward the seat 114. If this motion were not limited, the backrest 112 and seat 114 could fold together, which raises a potential safety concern.

Thus, the track 124 can include stops that limit the range of movement of the backrest 112 and/or seat 114. An example of a stop is an upward-projecting member in the track 124, such as an upward-projecting bend The example of FIG. 1A includes two upward-projecting bends, a front bend 134 and a back bend 136. The guide assembly 132 cannot travel up the steep angle between the upward-projecting bends and the lower portion of the track 124. Thus, the front bend 134 limits the forward lateral travel of the seat 114. The limitation upon lateral travel of the seat 114 also results in a limitation upon the amount that the backrest 112 reclines. Consequently, the front bend also defines the fully reclined backrest 112 position. The back bend 136, limits the backward lateral travel of the seat 114 (and, consequently, defines the upright backrest 112 position). One or more of these bends can be eliminated if no limitation on the forward and/or backward lateral movement of the seat 114 is desired, other than the limitations created by the pivot connections described herein. Moreover, alternative stops can be employed, such as solid stoppers placed along the track 124. The guide assembly 132 and track 124, including the front bend 134 and back bend 136 is shown in greater detail in FIG. 7.

Figure 9:
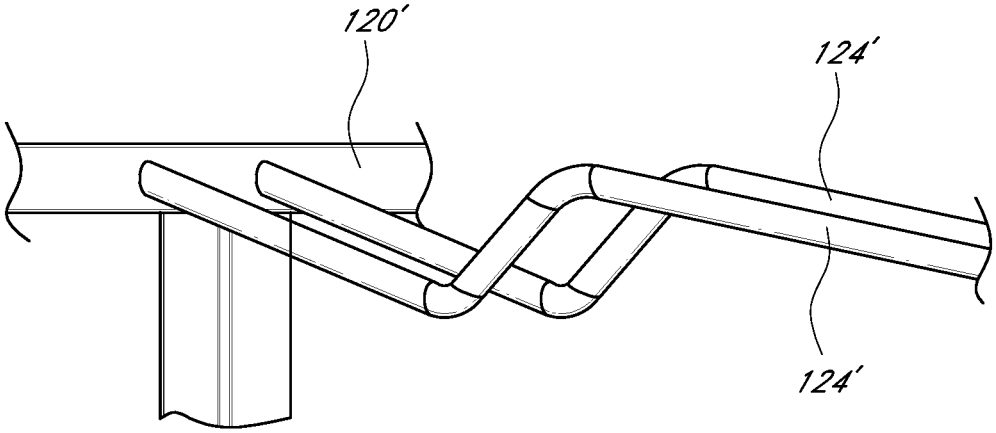
FIG. 9 shows a rear-perspective view of the connection between the inner tracks and the front member of the frame in the example frame of FIG. 8.

Frame components for a couch or loveseat are shown in FIG. 8. The example loveseat has outer armrests, but lacks inner armrests. The sides of the frame include outer tracks 124 extending between upright front members 120 and upright first rear members 126. The side tracks 124 include a front bend 134 and a back bend 136. The center of the frame includes inner tracks 124' extending between a laterally-extending front member 120' and an upright first rear member 126'. FIG. 9 shows a detailed rear-perspective view of the connection between the inner tracks and the front member 120' of the frame. A seat and backrest can be engaged with the frame, as described above, between each set of inner and outer tracks. The assembled loveseat would thus comprise a pair of reclining seats and backrests. In the example of FIG. 8, downwardly-extending guide assemblies (not shown) can be installed on the bottom of the seats (not shown) to engage the inner tracks 124', while laterally-extending guide assemblies (not shown) can be installed on the sides of the seats to engage the outer tracks 124. When so installed, the front bends 134 of the outer tracks 124 would limit the forward travel of the seats. A three-person couch can be constructed by adding one or more additional seats and backrests between two outer seats and backrests. The additional seats and backrests can be reclinable or stationary.

For purposes of summarizing the inventions and the advantages achieved over the prior art, certain items and advantages of the inventions have been described herein. Of course, it is to be understood that not necessarily all such items or advantages may be achieved in accordance with any particular embodiment of the inventions. Thus, for example, those skilled in the art will recognize that the inventions may be embodied or carried out in a manner that achieves or optimizes one advantage or group of advantages as taught or suggested herein without necessarily achieving other advantages as may be taught or suggested herein. Moreover, various embodiments and features are described herein and it will be understood that the disclosure is intended to include all combinations and selections of those embodiments and features, rather than to be limited to the disclosure to a specific combination or feature that may be disclosed in a particular paragraph hereof.

What is claimed is:

1. An assembly for use in reclinable seating comprising a reclining member configured to recline from a first position to a second position and a seat member configured to move in relation to the reclining member and comprising a front portion facing away from the reclining member when in use and a rear portion facing toward the reclining member when in use, the assembly comprising:

a first member configured to support the seat member, at least a portion of which first member is positioned near the front of the seat member and configured to contact a floor or ground surface;

a second member configured to support the seating member, at least a portion of which second member is positioned near the reclining member and the rear of the seat member and configured to contact the floor or ground surface;

a track configured to connect with at least the first member, wherein, in use, the track slopes downward from the direction of the first member to the direction of the second member;

a guide configured to engage the track, the guide and the track configured to incline the front portion of the seat member as the reclining member reclines, such that, when in use, a vertical distance between the front portion of the seat member and the floor or ground surface is greater when the reclining member is in the second position than when the reclining member is in the first position, the guide comprising a slide portion configured to slide along the track in a continuous smooth movement in response to changes in a user's center of gravity; and means for adjusting friction between the slide portion and the track.

2. A chair comprising the assembly of claim 1.

3. The assembly of claim 1, wherein the guide is configured to be higher on the slope of the track when the reclining member is in the second position than when the reclining member is in the first position.

4. A couch comprising the assembly of claim 1.

5. The assembly of claim 1, further comprising a pivot member configured to contact the reclining member so that the reclining member can pivot about the pivot member.

6. The assembly of claim 5, wherein the pivot member comprises a generally horizontally-extending bar.

7. The assembly of claim 5, wherein the pivot member is configured to connect to the reclining member when in use.

8. An assembly for use in reclinable seating comprising a reclining member configured to recline from a first position to a second position and a seat member configured to move in relation to the reclining member and comprising a front portion facing away from the reclining member when in use and a rear portion facing toward the reclining member when in use, the assembly comprising:

a first member configured to support the seat member, at least a portion of which first member is positioned near the front of the seat member and configured to contact a floor or ground surface;

a second member configured to support the seating member, at least a portion of which second member is positioned near the reclining member and the rear of the seat member and configured to contact the floor or ground surface;

a sloping track configured to connect with at least the first member; and a guide configured to moveably engage the track, the guide and the track configured to incline the front portion of the seat member as the reclining member reclines, such that, when in use, a vertical distance between the front portion of the seat member and the floor or ground surface is greater when the reclining member is in the second position than when the reclining member is in the first position, the guide comprising a slide portion configured to slide along the track in a continuous smooth movement in response to changes in a user's center of gravity, wherein the guide is configured to be higher on the slope of the track when the reclining member is in the second position than when the reclining member is in the first position and the track is configured to limit a range of motion of the slide portion on the track when in use.

9. The assembly of claim 8, further comprising means for adjusting friction between the slide portion and the track.

10. A chair comprising the assembly of claim 8.

11. The assembly of claim 8, wherein, in use, the track slopes downward from the direction of the first member to the direction of the second member.

12. A couch comprising the assembly of claim 8.

13. The assembly of claim 8, further comprising a pivot member configured to contact the reclining member so that the reclining member can pivot about the pivot member.

14. The assembly of claim 13, wherein the pivot member is configured to connect to the reclining member when in use.

15. The assembly of claim 13, wherein the pivot member comprises a generally horizontally-extending bar.

16. The assembly of claim 15, wherein the track is configured to limit a range of motion of the slide portion on the track when in use.

* * * * *